US009280889B2

(12) United States Patent
Williamson

(10) Patent No.: US 9,280,889 B2
(45) Date of Patent: Mar. 8, 2016

(54) ALERT NETWORK AND METHOD FOR TRANSMITTING AND PROPAGATING ALERTS

(71) Applicant: KIWATCH, Orvault (FR)

(72) Inventor: Cedric Williamson, Nantes (FR)

(73) Assignee: KIWATCH, Orvault (FR)

( * ) Notice: Subject to any disclaimer, the term of this patent is extended or adjusted under 35 U.S.C. 154(b) by 16 days.

(21) Appl. No.: 14/292,265

(22) Filed: May 30, 2014

(65) Prior Publication Data

US 2015/0348398 A1 Dec. 3, 2015

(51) Int. Cl.
*G08B 23/00* (2006.01)
*G08B 25/00* (2006.01)

(52) U.S. Cl.
CPC ..... *G08B 25/004* (2013.01)

(58) Field of Classification Search
CPC ..... H04W 76/007; H04W 88/04
USPC ..... 340/501, 517, 3.1, 3.22, 3.23, 3.3, 7.29; 370/312
See application file for complete search history.

(56) References Cited

U.S. PATENT DOCUMENTS

| | | | | |
|---|---|---|---|---|
| 6,661,340 | B1 * | 12/2003 | Saylor et al. | 340/517 |
| 7,825,793 | B1 | 11/2010 | Spillman et al. | |
| 2011/0237217 | A1 * | 9/2011 | Monks et al. | 455/404.1 |
| 2014/0269482 | A1 * | 9/2014 | Pandey et al. | 370/312 |

FOREIGN PATENT DOCUMENTS

| | | | |
|---|---|---|---|
| CH | 696 048 | A5 | 11/2006 |
| GB | 2 504 119 | A | 1/2014 |
| WO | 2009/023647 | A1 | 2/2009 |

OTHER PUBLICATIONS

1-Search Report for European Patent Application No. 15170125.7 filed in the name of Kiwatch. Dated: Nov. 23, 2015.
2- Examination Report for European Patent Application No. 15170125.7 filed in the name of Kiwatch. Dated: Nov. 23, 2015.

* cited by examiner

*Primary Examiner* — Toan N Pham
(74) *Attorney, Agent, or Firm* — Steinfl & Bruno LLP

(57) ABSTRACT

An alert network is described. The alert network has a plurality of individual monitoring systems, a plurality of user terminals respectively associated with the individual monitoring systems, alert transmitters in the monitoring systems, for transmitting primary alerts to selected user terminals and/or to other monitoring systems in accordance with parameterized transmission rules, alert receivers in said terminals, and alert propagators in the terminals, capable of selectively propagating received primary alerts to other terminals and or to other monitoring systems as secondary alerts, in accordance with parameterized propagation rules. A method for transmitting and propagating alerts according to corresponding parameters in such a network is also described.

17 Claims, 4 Drawing Sheets

ALERT NETWORK AND METHOD FOR TRANSMITTING AND PROPAGATING ALERTS

FIELD

The present disclosure relates to monitoring systems and more particularly to remote monitoring and to systems for the safety of property and people.

BACKGROUND

Private individuals are more and more often equipped with computer facilities comprising intrusion or fire sensors to trigger a siren or to cause a call to a telephone exchange in case of an alert.

Advanced solutions have recently been developed:

- the D-Link® system proposes a camera coupled to the internet allowing to the user to watch remotely what happens at home thanks to a cell phone like an iPhone®, an iPad® or an Android® terminal equipped with a browser. Furthermore, the camera comprises:
  - an infrared lighting system allowing night vision,
  - a motion detector coupled to an email manager to send an email in case of an alert,
  - a local storage system for the video recordings.
- The commercial Dropcam® system additionally allows:
  - sharing the video streams captured by the camera with his camera with his networks of friends,
  - switching on or off the remote monitoring system or automatically depending on the geolocation of the user's terminal,
  - archiving and consulting with time delay the video recordings recorded by the monitoring system.
- The commercial Belkin Netcam® additionally allows associating the link of a video recorded by the monitoring system with an alert email automatically sent in case of motion detection.

However, these solutions are vulnerable: if the monitoring system of a user comprises blind spots or is neutralized by the offender, its recordings will be unusable to track him down.

SUMMARY

It has been observed that, in a residential area, many people are equipped with monitoring systems. However, each system is individual. Therefore, an offender or intruder may very well neutralize a given monitoring system and be in the vicinity of many other systems that, if they are inactive, will bring no help in identifying the offender.

It appears that these other monitoring systems could usefully be activated to record traces of a passage of an intruder and the owners of these other systems could themselves usefully be alerted as potential witnesses of an intrusion or of an assault at a neighbor's.

The present disclosure relates to a monitoring network composed of individual monitoring systems and of user terminals of persons who can be potential witnesses or can potentially be helpful, as well as a method for propagation of an alert in this monitoring network.

More particularly, according to a first aspect of the present disclosure, an alert network is provided, the alert system comprising: a plurality of individual monitoring systems, a plurality of user terminals respectively associated with the individual monitoring systems, alert transmitters in said monitoring systems, for transmitting primary alerts to selected user terminals and/or to other monitoring systems in accordance with parameterized transmission rules, alert receivers in said terminals, and alert propagators in said terminals, capable of selectively propagating received primary alerts to other terminals and or to other monitoring systems as secondary alerts, in accordance with parameterized propagation rules.

Certain preferred but non-limiting aspects of this network are the following:

- the network further comprises a common monitoring server capable of storing alert information transmitted by said monitoring systems.
- said monitoring server comprises an alert network manager adapted to handle the transmission and propagation parameters.
- said alert propagators are further capable of selectively propagating to other monitoring systems activation and/or recording instructions for one or several components of said other monitoring systems.
- said alert propagators are further capable of selectively propagating to other monitoring systems warning signal triggering instructions for one or several components of said other monitoring systems.
- said user terminals further comprise data input units for inputting alert-related information.
- the plurality of user terminals include a group of user terminals connected via a social network.

According to a second aspect of the present disclosure, a method for handling alerts in an alert network is provided, the method comprising a plurality of individual monitoring systems, a plurality of user terminals respectively associated with the individual monitoring systems and an monitoring server, said monitoring systems and said user terminals being selectively connectable to each other within said alert network, the method comprising the following steps:

- when an abnormal condition in a given monitoring system is detected, transmitting a corresponding alert as a primary alert to a given set of user terminals in accordance with user-defined primary alert transmission parameters accessible by said monitoring system,
- at each user terminal receiving such primary alert, in accordance with propagation parameters accessible by the user terminals, propagating said primary alert as a secondary alert to another set of user terminals in accordance with user-defined primary alert propagation parameters accessible by said user terminals.

Certain preferred but non-limiting aspects of this method are the following:

- said user-defined primary alert transmission parameters include at least one among alert types, connection modes with primary alert recipient user terminals, recipient user terminal identifiers, recipient user categories, alert message contents, time-related conditions, location-related conditions, authorizations for access by recipient user terminals to alert data.
- said primary alert transmission step comprises also transmitting the alert to another monitoring system.
- a primary alert transmitted to another monitoring system includes activation and/or recording instructions for one or several components of said another monitoring system.
- said primary alerts are received in accordance with user-defined primary alert reception parameters set by recipient user terminals.
- said user-defined primary alert reception parameters include at least one among alert reception enablement, alert reception requests, transmission mode conversion, time-dependent connection mode conversion, action triggering.

said user-defined alert propagation parameters include at least one among alert types, connection modes with secondary alert recipient user terminals, recipient user terminal identifiers, recipient user categories, alert message content or content modification, time-related conditions, location-related conditions, authorizations for access by second alert recipient user terminals to alert data.

the method further comprises the following step:

at each user terminal receiving a secondary alert, in accordance with user-defined re-propagation parameters accessible by the user terminals, re-propagating said secondary alert to another set of user terminals in accordance with secondary alert re-propagation parameters accessible by said user terminals.

at least part of said parameters are stored in the user terminals.

at least part of said parameters are stored in the monitoring server.

Thanks to this network and method according to the present invention, normally separated systems can form a monitoring array substantially improving the number of recorded traces of the passage of intruders/offenders, and to multiply the number warnings such as sirens and alarm messages of potentially many user terminals.

BRIEF DESCRIPTION OF THE DRAWINGS

The present disclosure will be better understood from the following detailed description of a preferred embodiment thereof, given by way of non-limiting examples and made with reference to the appended drawings, in which.

DETAILED DESCRIPTION

1) System

Figure 1:
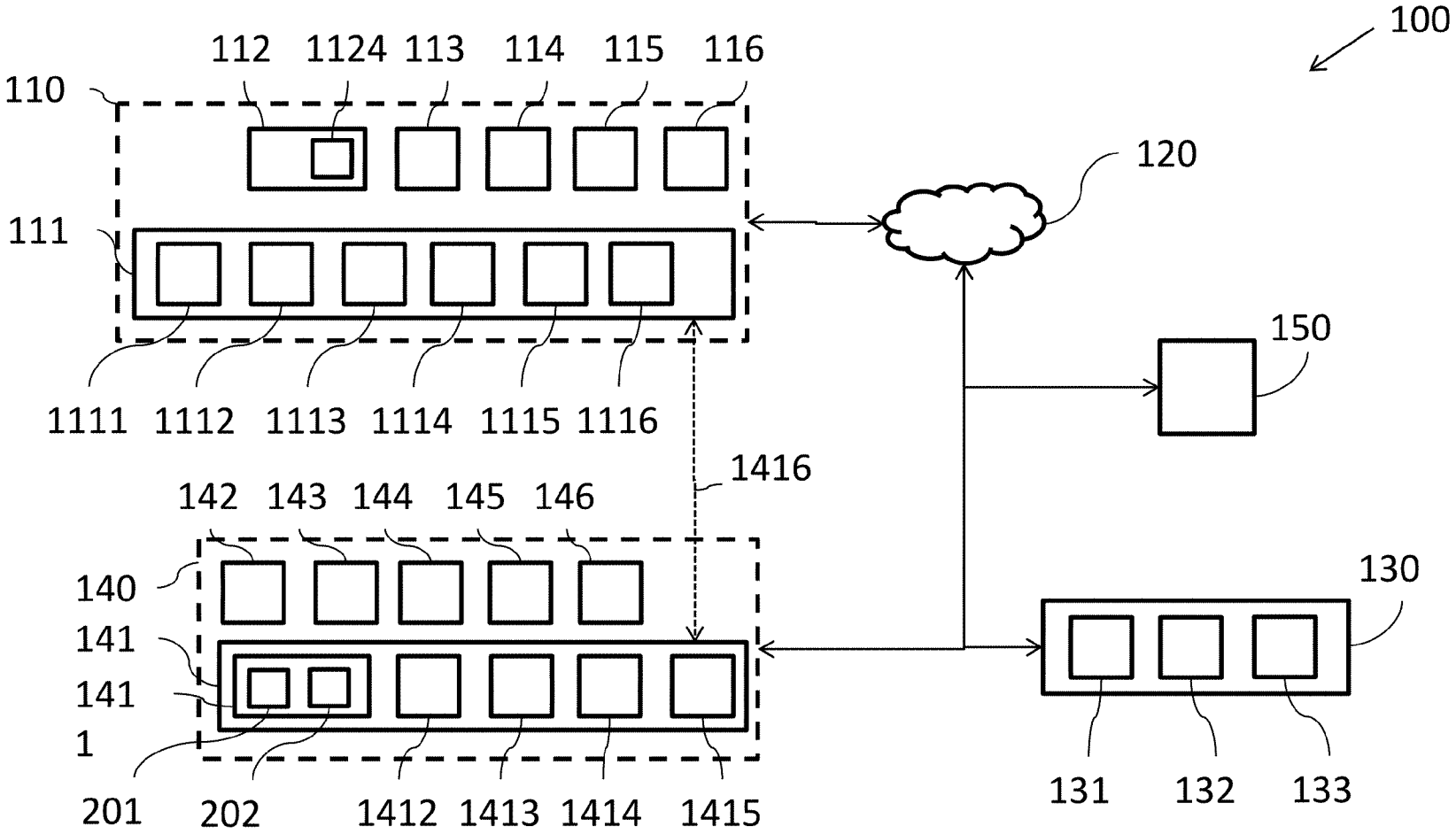
FIG. 1 diagrammatically shows a system comprising a set of user terminals connected via Internet and a monitoring server to a set of individual alarm monitoring systems.

Referring to FIG. 1, a group of users 110 includes a plurality of user terminals 111 to 116 connected via a network 120 such as the Internet to a monitoring server 130 and to a group 140 of monitoring systems 141 to 146. To a given monitoring system 141 is associated at least one owner terminal 111, according to an association link 1416. Social networks 150 such as the applications Facebook®, Whatsapp®, Twitter® applications, electronic mail, SMS or telephone message services are accessible by the user terminals, the monitoring server and the monitoring systems.

A terminal 111 comprises a smartphone such as an iPhone® or an Android® mobile, equipped with an operating system 1111 such as iOS® operating a geolocation module 111, a module for social network management 1113 consisting of a local application or a browser for connecting to one or more of the social networks 150 and with a network manager 132 contained in the monitoring server, a module 1114 for parameterizing primary alerts, a module 1115 for parameterizing secondary alerts and a module 1116 for managing the human-machine interface of terminal 111.

The terminal 112 is similar to terminal 111 and is provided with equivalent modules 1121-1122-1123-1124-1125-1126. The same applies to terminals 113-114-115-116.

In the following description, the references 111-112-113-114-115-116 shall designate for convenience the users/owners or their respective terminals.

2) Module for Primary Alerts Parameterization

The module 1114 for parameterizing primary alerts allows user 111 to define the transmission parameters 210 (as described in detail below with reference to FIG. 2) of a primary alert transmitted by his own monitoring system 141 by means of a link 1416. To this purpose, this module 1114 may cooperate with the social network management module 1113. For instance, user 111 can parameterize his monitoring system 141 so that he is informed by the system via SMS (alert 201), as well as his neighbor 112 (alert 202), in case of an intrusion during the weekend.

A recipient 112 can then parameterize reception parameters 220 of a primary alert 202 thanks to a similar parameterization module 1124, as described in detail below. For instance, user 112 can filter the alerts so as to receive a primary alert 202 only via email during the night.

3) Module for Secondary Alert Parameterization

The module 1115 for parameterizing secondary alerts also allows user 111 to define propagation parameters 230, described in detail below, of a primary alert 201 generated by his own monitoring system 141. By contrast with the generation of a primary alert 201, this propagation is carried out only after action on the terminal of the owner 111 or of a recipient 112. This action is a propagation triggering 238 as described in detail below.

When a primary alert 201 is propagated according to the propagation parameters 230, it becomes a secondary alert 205-206.

User 113 defines reception parameters 240 and re-propagation parameters 250 for a secondary alert 205 thanks to a module 1135 (not shown) for parameterizing secondary alerts, as described in detail below. To this end, module 1135 cooperates with the social network management module 1133 (not shown) of terminal 113.

4) Monitoring Server

The monitoring server 130 is a Web server equipped with an operating system 131, a network manager 132 and a database 133.

The network manager 132 manages the monitoring network 200 formed by the cooperation of terminals 110, monitoring systems 140 and the social networks 150. This network manager 132 can be parameterized by modules 1114-1124-1134 for parameterizing primary alerts and by modules 1115-1125-1135 for parameterizing secondary alerts, that define the parameters 210, 220, 230, 240 and 250 as described in detail below.

The database 133 stores information relating to the organization and to the parameterization of monitoring system 200, and in particular:

the files generated by the monitoring systems 240, such as pictures 321 or video files 322, the alert notes 341 and additional information 342-343 as described in detail below.

5) Monitoring System

A monitoring system 141 comprises a set of sensors 1412 connected to a data processing system 1411 that can generate alerts 201-202 and transmit them to server 130. This system preferably comprises:

- a home WiFi home network connected to the Internet constructed, for example based on a Freebox® system;
- a camera connected to the WiFi home network, such as a D-Link DCS 242L® camera; this camera is motor-driven and can be remotely controlled;
- infrared LEDs for night vision and/or microphones allowing to record intruders conversations, as mounted on the D-Link DCS 242L® camera;
- other sensors or detectors specialized in home automation or damage detection: closed/open doors, shutters or taps, heaters, temperature, smoke, heat, flood;
- other sensors specialized in motion detection of intruders, animals (including monitoring the passage of wild animals);
- a microphone equipped with a band pass filter, specialized in the detection of an alarm siren;
- a system for recognition of sound image/sound pattern, capable of detecting an alarm siren;
- a system for recognition of video images that can interpret the suspicious behavior of an intruder or the distress behavior of an elderly person, filmed by the camera;
- a geolocation system.

This system can generate an alert 201-202-203 and an accompanying message 215, and transmit them to a recipient 111-112-142 via network 120 in the following way:

- an alert 201 is generated by the computer system 1411 in response to the detection of motion, smoke, distress behavior, etc. by the sensors 1412 and the associated recognition systems;
- to this alert 201 is associated a first message 215 containing a photo 321 taken by the camera; which is first transmitted in HTTP mode to server 130. Since the server 130 can transfer this message to the monitoring network 200 without any delay, the recipients 111-112 can take notice of alert 201 and instantaneously visualize the photo 321; and
- a second message 215 containing the video 322 recorded by the monitoring system is then transmitted to the server 130 in FTP mode. The recipients 111-112 can then access the video files 322 recorded by monitoring system 141.

6) Monitoring Network a) Primary Alert Transmission Parameters

Figure 2:
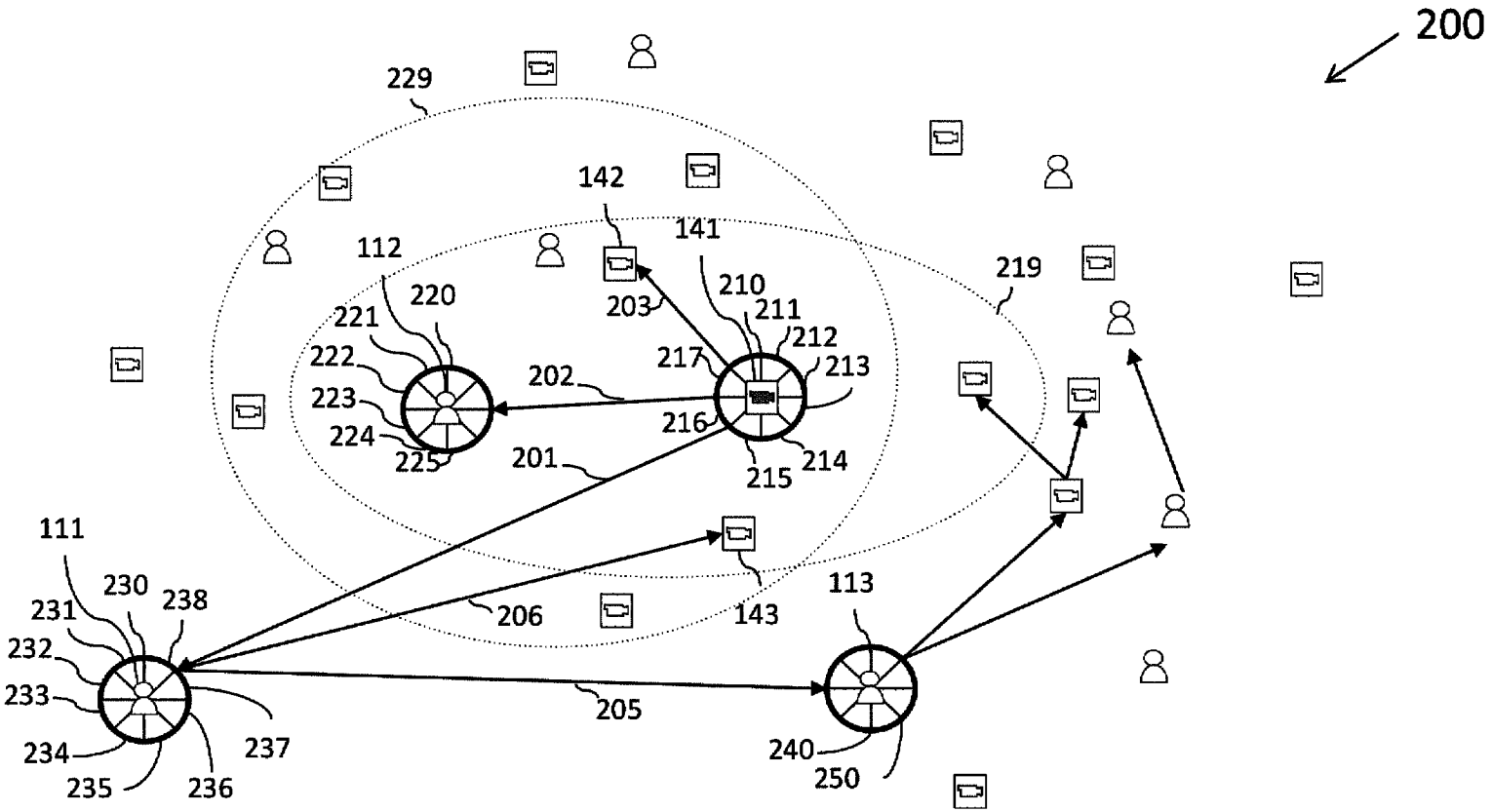
FIG. 2 diagrammatically shows a monitoring network formed by individual alarm monitoring systems and by users within which an alert according to the method of the invention propagates.

Referring to FIG. 2, the monitoring network 200 is handled by the network manager 132. This network comprises the set of user terminals 111-112-113 and the set of monitoring systems 141-142. A monitoring system 141 can transmit a primary alert 201-202-203 according to parameters 210 defined by its owner 111 thanks to module 1114.

The transmission parameters 210 of a primary alert are in particular the following:

- categories 211 of primary alerts 201-202-203; for instance, a fire alert can be classified into a different category than an intrusion alert or an assistance request alert transmitted by an elderly person;
- support applications 212 for the primary alerts 201, by category 211; for instance, a fire alert can cause the transmission of a SMS, while an intrusion alert will cause the transmission of an email and of a Whatsapp® message;
- the list 213 of recipients 111-112-142 of a primary alert 201-202-203, per category 211 and per support application 212; for instance, the owner 111 of a monitoring system 141 can define, in the list of his friends identified by the social network management module 1113, a first list of recipients for a fire alert and a second list of recipients for an intrusion alert; more generally, the owner can define a relationship between the category 211 of an alert (fire, flood, intrusion, . . . ), the support application 212 (SMS, email, Facebook, a dedicated/personalized alert system, . . . ), and lists 213 of recipients (personal contacts, neighbors, certain friends, all my friends, the whole network, . . . );
- the categories 214 of recipients 111-112-142, and in particular:
  - a recipient 111 can be the owner of the monitoring system 141,
  - a recipient 112 can be a neighbor, a friend or a person registered in the monitoring social network,
  - a recipient 142 can be another monitoring system; for instance, an intrusion alert 203 coming from a monitoring system 141 can cause the switching to the record mode of another monitoring system 142 situated nearby. An intruder can thus be caught in an array of cameras storing traces of his passage.
- category-specific messages 215 associated with primary alerts 201-202-203, per category 211-214, for instance:
  - a SMS message such as "Fire alert at Duponts', 5, rue du Rocher",
  - a vocal message transmitted by an automatic messaging system to the phone of the recipient,
  - a computer-generated message transmitted to another monitoring system 142 in order to trigger an alarm siren or a video recording,
  - a predefined message depending on the triggered sensors, e.g.: "intrusion alert—the garage door has been opened";
  - a message computed and generated by an image recognition system, e.g. "Mrs. Dupont is asleep at an unusual time"; "the alert seems to have been triggered by a cat—checking required"; "the plate number of the suspicious car is CAW 3456",
- transmission conditions 216 depending on time schedules or geolocation, and also depending on categories 211-214; for instance, a prospective recipient 112 can be informed on a fire alert 202 provided that his terminal be located in an area 219 situated less than one kilometer from this alert;
- access authorizations 217 depending on categories 211-214; the owner 111 can thus authorize a recipient 112 to:
  - visualize the video 322 and sound recordings coming from his monitoring system 141 in case of an alert, or in time delayed manner from database 133;
  - steer the drive motor of a remote controlled camera;
  - trigger an alarm siren;
- automatic actions 218 of the monitoring system 141, depending on categories 211-214, and for instance:
  - record a video and continuously stream it to server 130;
  - trigger an alarm siren.

These parameters 210, like the following ones, are defined by default by the social network management module 1113 and parameterize the monitoring network manager 132.

b) Reception Parameters of a Primary Alert

The reception parameters 220 of a primary alert 202 are defined by the recipient 112 of this alert. If the recipient of this alert 203 is a monitoring system 142, these parameters are defined by his owner.

These reception parameters 220 are in particular the following:

- a reception authorization 221: the recipient 112 can for instance accept or refuse the primary alerts 202 coming from the monitoring system 141, the user 111 of which is the owner and has proposed to recipient 112 to accept these alerts;
- a reception request 222: the recipient 112 can request to be the recipient of primary alerts transmitted by any monitoring system included in a given area 229; preferably, the respective owners of the monitoring systems located in this area 229 will be able to then accept or refuse such request;
- the reception conditions 223, which can depend, for example, on the geolocation or on time schedules; for instance, the reception of a primary intrusion alert can be reception-filtered at night;
- the reception mode 224: the recipient 112 can for instance modify the accompanying message of a primary alert 201, or the support application 212; for instance, an alert parameterized by the user 111 as a SMS can be re-parameterized by user 112 as an automatic phone call.
- the triggering of an action 225: recipient 112 can thus decide that all the monitoring systems of which he is the owner will broadcast their videos on server 130 in case of reception of an intrusion alert 202.

By combining parameters 221-222-223-224, each recipient 112 can filter the primary alerts 201 received in order to re-dispatch them again in additional or replacement reception modes (SMS, email, Facebook®, . . . ).

Thus, an alert 201 received by SMS on a mobile terminal can cause the generation of a Facebook® message, depending on a planning that determines the preferred alert mode depending on determined time ranges.

c) Propagation Parameters of a Secondary Alert

A recipient 111 of a primary alert 201 defines the propagation parameters 230 of this alert. When propagated, a primary alert 201 becomes a secondary alert 205-206. Similarly to the transmission parameters 210 of a primary alert, the propagation parameters 230 define in particular:

- categories 231 of secondary alerts;
- support applications 232 for secondary alerts;
- the list 233 of recipients 113-143 of the propagated secondary alert, per category 231,
- the categories 234 of secondary recipients,
- messages 235 accompanying the secondary alerts; thus a recipient 111 can complete a message 215, for example:
  - by adding a comment to the received photo: "I do not know the person who appears on this photo";
  - by adding links towards additional information stored in database 133;
- transmission conditions 236,
- access authorizations 237.

d) Triggering the Propagation of a Secondary Alert

The propagation triggering 238, which can also be parameterized, is necessary for the propagation of a primary alert, i.e. its dispatching towards other terminals 113 or monitoring systems 143. It is caused for instance by the actuation by user 111 of a propagation enabling button 351 comprised in the human-machine interface of his terminal. Other propagation triggering modes 238 are explained in detail below.

e) Reception Parameters of a Secondary Alert

Similarly to the primary alert reception parameters 220, the reception parameters 240 of a secondary alert 205 allow to define:

- the reception authorization,
- the reception conditions,
- the reception mode.

f) Re-Propagation Parameters of a Secondary Alert

Similarly to the propagation parameters 230 of a primary alert, the re-propagation parameters 250 of a secondary alert 205 define:

- categories of secondary alerts,
- applications receiving secondary alerts,
- the list of re-propagation recipients,
- accompanying messages,
- triggering conditions for the re-propagation.

7) Human-Machine Interface

Figure 3:
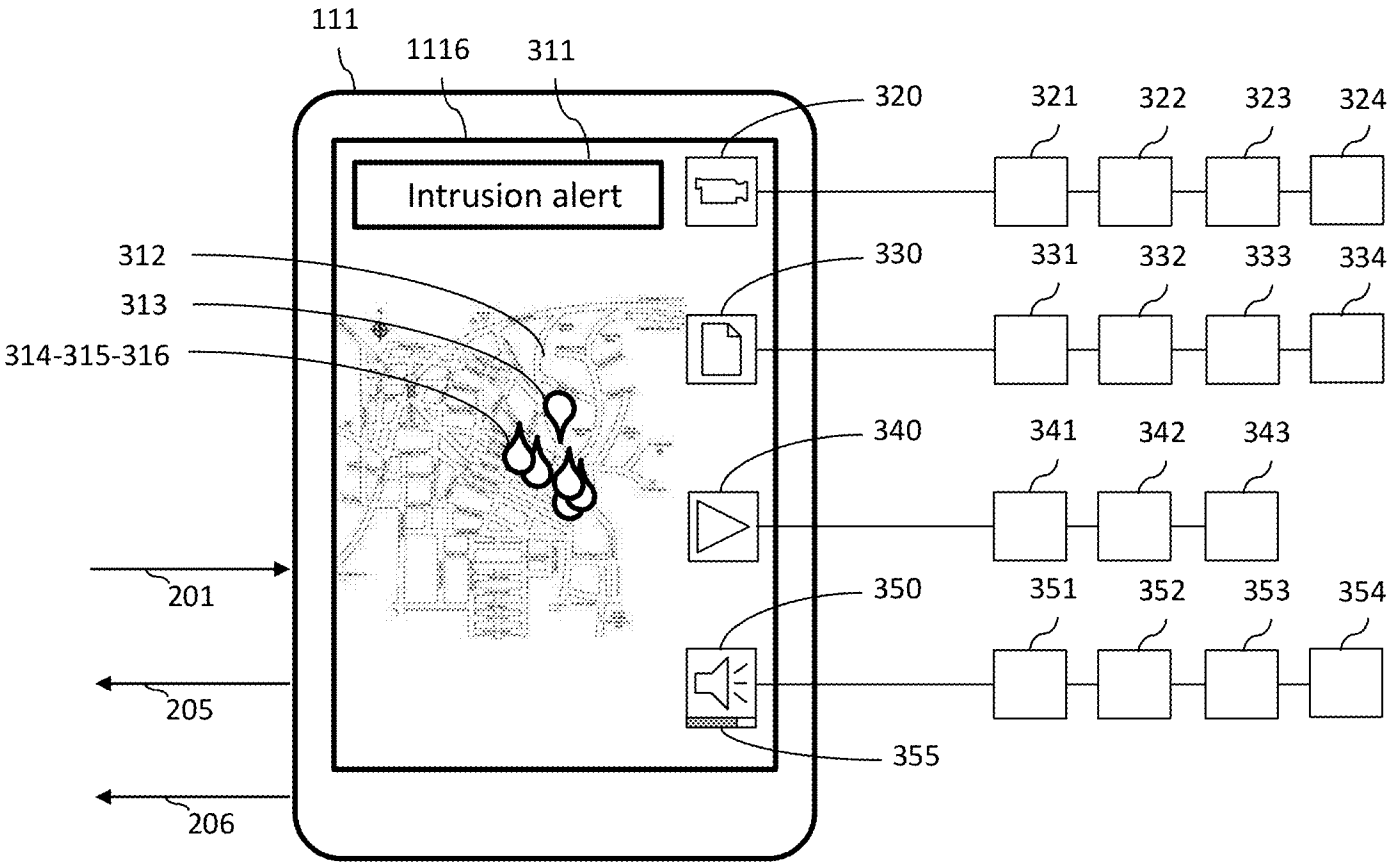
FIG. 3 diagrammatically shows the human-machine interface of a terminal, allowing to parameterize and to use the system of the invention.

Referring to FIG. 3, user terminal 111 receives a primary alert 201 together with an accompanying message 215 from a monitoring system 141 via the monitoring server 130 and Internet network 120.

Thanks to the human-machine interface management module 1116, an alert message 311 is displayed according to the content of message 215. For instance, if a sensor of monitoring system 141 has detected the opening of the garage door, the alert message 311 will be "intrusion alert—the garage door has been opened".

A pictogram 313 indicates the location of the monitoring system 141 on a map 312. Pictograms 314-315-316 designate the other monitoring systems 142-143 and neighboring terminals 112-113-114 with color codes enabling to differentiate them according to different criteria, in particular:

- their accessibility: "already authorized" for the user 111 (according to an authorization reciprocal to authorization 217), "authorization pending", or "suggested" by the social network management module 1113; thus user 111 can for instance see the cameras the archives of which he can visualize in database 133, or those to which he could quickly have access;
- their activity: when a monitoring system 142 in the neighborhood recently generated an alert, it is highlighted in red to draw the attention of user 111;
- their relational proximity within the meaning of social networks 150.

By activating a pictogram 314, user 111 accesses associated information (e.g. address, contact details of the owner . . . ) and actions (e.g. contact the owner, add to the list of propagation recipients . . . ).

Thanks to the view menu 320, user 111 can get more information on the alert by visualizing:

- a photo 321 taken by the monitoring system 141 and transmitted to server 130 in HTTP mode,
- a video 322 taken by the monitoring system 141, transmitted to server 130 in FTP mode,
- other photos and videos 323 stored in database 133, coming from other monitoring systems 142-143 accessible by user 111, in particular those who are location-wise and time-wise close to alert 201,
- the state 324 of the other sensors 1412 of the monitoring system 141 or of other monitoring systems 142-143 accessible by the user 111, or their archive stored in database 133.

Thanks to the parameterization menu 330, user 111 can access the modules 1114-1115 for primary and secondary alerts parameterization. He can thus define or modify:

- the transmission parameters 210 of a primary alert 201-202-203, by means of menu 331,
- the reception parameters 220 of a primary alert 201-202-203, by means of menu 332,
- the propagation parameters 230 of a secondary alert 205-206, by means of menu 333,
- the reception and re-propagation parameters 240, 250 of a secondary alert 205, by means of menu 334.

Thanks to the data input menu 340, the user 111 can input information concerning the primary alert 201:

by filling an alert information note 341, as known by the skilled person; for instance, the Spotcrime® service proposes a website that stores and archives a crime database; a crime act is described by:

a date, for example "04/17/2014 10:36 AM", a type, for example "shooting/stabbing", a comment, for example "PD units o/s rptg a male shot in the chest—Crime scene established", a geolocation, for example "4XX Central Ave., Brooklyn, N.Y.";

by establishing a selection 342 of photos, of videos, or of sensor status information, thus allowing to better explain the causes of the alert, by establishing links 343 between this selection 342 and the alert accompanying message 235.

Thanks to the propagation menu 350, user 111 can define or modify the propagation triggering parameters 238:

by actuating the propagation enabling button 351; for instance, user 111 may take time to view a recorded video, to write a message, or to add secondary recipients before actuating the propagation enabling button 351;

by actuating the propagation forcing button 352;

by actuating the alert acknowledgment button 353, which inhibits its propagation and transmits a message to the other recipients 112 of the primary alert, by setting 354 a time-delay 355 at the end of which the propagation is triggered if the acknowledgment 353 has not been actuated by any of the recipients of the primary alert on their respective terminals.

When the propagation triggering 238 is active, user terminal 111 transmits the secondary alerts 205 and 206.

8) Process

Figure 4:
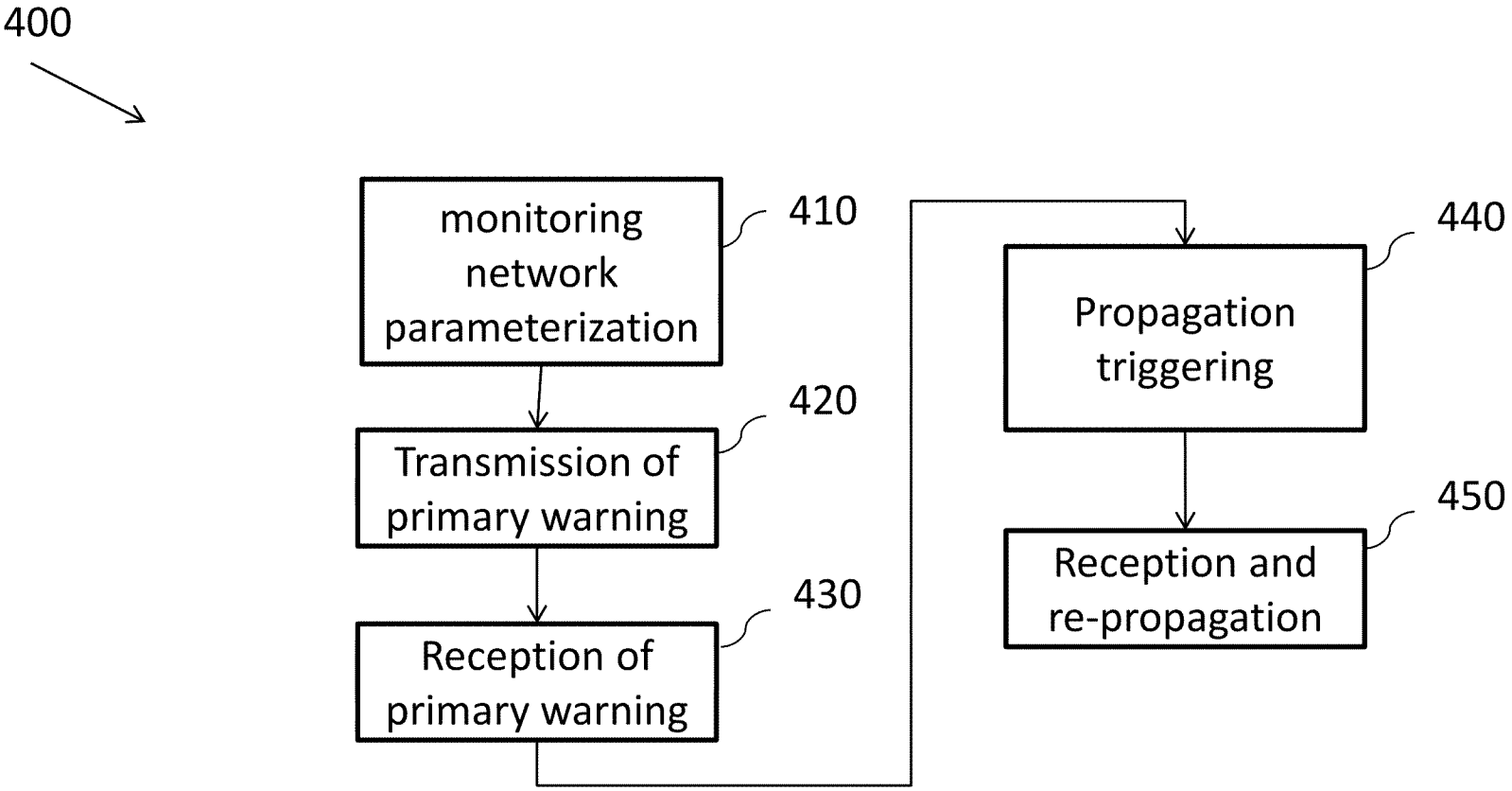
FIG. 4 is a flow chart illustrating the propagation process of an alert in the monitoring network.

Referring to FIG. 4, the process 400 defines the propagation steps of an alert in a monitoring system 200 according to this invention.

In step 410, the users 110 of the monitoring network 200 define the parameters thereof and in particular:

user 111 defines the transmission parameters 210 for the primary alerts 201-202-203 of his own monitoring system 141 according to link 1416; he uses for this purpose the menu 331 of the human-machine interface 1116 of his terminal, that cooperates with the primary alert parameterization module 1114;

user 112 (respectively 111) defines the reception parameters 220 of a primary alert 202 (respectively 201) of which he is the recipient; he uses for this purpose the menu 332 of the human-machine interface 1126 (resp. 1116) of his terminal, that cooperates with the primary alert parameterization module 1124 (resp. 1114);

user 111 defines the propagation parameters 230 of a secondary alert 205-206; he uses for this purpose the menu 333 of the human-machine interface 1116 of his terminal, that cooperates with the secondary alert parameterization module 1115;

user 113 defines the reception parameters 240 and the re-propagation parameters 250 of a secondary alert 205; he uses for this purpose the menu 334 of the human-machine interface 1136 of his terminal, that cooperates with the secondary alert parameterization module 1135.

In step 420, the monitoring system 141, in cooperation with server 130, transmits a primary alert 201 in accordance with of the transmission parameters 210 stored in network manager 132.

In step 430, user terminal 111 receives the primary alert 201 in application of the reception parameters 220. The user can:

inform himself more fully about the alert thanks to the view menu 320;

modify the propagation parameters 230 of the secondary alerts by means of the parameterization menu 330;

input alert information thanks to the data input menu 340;

modify the propagation triggering parameters 238 by means of the the propagation menu 350.

In step 440, user terminal 111 triggers the propagation 238 in accordance of the commands of the propagation menu 350 and transmits a secondary alert 205 in application of the propagation parameters 230.

In step 450, user terminal 113 receives and re-propagates the secondary alert 205 in application of the reception and re-propagation parameters 240, 250.

9) Variants

The skilled person will be able to derive from the above description many variants. In particular:

a user terminal such as 111 can be a tablet such as an iPad®, a microcomputer, an intelligent watch such as a Smartwatch®, a Google Glass® system or any other type of personal device;

the user of terminal 111 can be a security agent working for a shop, a company, a warehouse, an industrial area, a township, a town or any other local structure equipped with a remote monitoring system;

a monitoring system 141-142-143 can be equipped with other types of sensors such as infrared sensors, ultrasonic sensors, microwave sensors, photoelectric-barrier sensors, glass-breakage sensors, carbon content sensors, vibration detection sensors, passive magnetic field sensors, micro-sound sensors; the monitoring system can further detect a power failure and be equipped with a power generator, and server 130 can detect monitoring system defect, failure or tampering when the latter ceases to transmit the expected signals;

a monitoring system 141-142-143 can be one among:

a remote assistance wrist bracelet for elderly people, equipped with an alert button, a smartphone equipped with an application that can transmit a geolocated alerts, such as the one commercially provided by Arkea Assistance®;

a satellite-connected dog collar such as the commercially-available Garmin Astro 320® collar;

a marine or Argos® beacon;

a connected camera, such as camera equipped with an integrated communication system connectable to a 3G/4G network;

a smoke detector connected to the commercially available SigFox® network;

or any other connected object capable of generating a geolocated alert.

The parameterizing or propagation functionalities can be limited depending on a subscription level of each user to the monitoring network 200.

A number of embodiments of the disclosure have been described. Nevertheless, it will be understood that various modifications may be made without departing from the spirit and scope of the present disclosure. Accordingly, other embodiments are within the scope of the following claims.

The invention claimed is:

1. An alert network comprising;

a plurality of individual monitoring systems, a plurality of user terminals respectively associated with the individual monitoring systems, alert transmitters in said monitoring systems, for transmitting primary alerts to selected user terminals and/or to other monitoring systems in accordance with parameterized transmission rules, alert receivers in said terminals, and alert propagators in said terminals, capable of selectively propagating received primary alerts to other terminals and or to other monitoring systems as secondary alerts, in accordance with parameterized propagation rules.

2. The alert network according to claim 1, further comprising a common monitoring server capable of storing alert information transmitted by said monitoring systems.

3. The alert network according to claim 2, wherein said monitoring server comprises an alert network manager adapted to handle the transmission and propagation parameters.

4. The alert network according to claim 1, wherein said alert propagators are further configured for selectively propagating to other monitoring systems sensor activation and/or recording instructions for one or several components of said other monitoring systems.

5. The alert system according to claim 4, wherein said alert propagators are further configured for selectively propagating to other monitoring systems warning signal triggering instructions for one or several components of said other monitoring systems.

6. The alert system according to claim 1, wherein said user terminals further comprise data input units for inputting alert-related information.

7. The alert system according to claim 1, wherein the plurality of user terminals include a group of user terminals connected via a social network.

8. A method for handling alerts in an alert network comprising a plurality of individual monitoring systems, a plurality of user terminals respectively associated with the individual monitoring systems and an monitoring server, said monitoring systems and said user terminals being selectively connectable to each other within said alert network, the method comprising the following steps:

transmitting a corresponding alert as a primary alert to a given set of user terminals in accordance with user-defined primary alert transmission parameters accessible by said monitoring system when an abnormal condition in a given monitoring system is detected, and propagating said primary alert as a secondary alert to another set of user terminals in accordance with user-defined primary alert propagation parameters accessible by said user terminals at each user terminal receiving such primary alert, in accordance with propagation parameters accessible by the user terminals.

9. The method according to claim 8, wherein said user-defined primary alert transmission parameters include at least one among alert types, connection modes with primary alert recipient user terminals, recipient user terminal identifiers, recipient user categories, alert message contents, time-related conditions, location-related conditions, authorizations for access by recipient user terminals to alert data.

10. The method according to claim 8, wherein said primary alert transmission step further comprises transmitting the alert to another monitoring system.

11. The method according to claim 10, wherein a primary alert transmitted to another monitoring system includes activation and/or recording instructions for one or several components of said another monitoring system.

12. The method according to claim 8, wherein said primary alerts are received in accordance with user-defined primary alert reception parameters set by recipient user terminals.

13. The method according to claim 12, wherein said user-defined primary alert reception parameters include at least one among alert reception enablement, alert reception requests, transmission mode conversion, time-dependent connection mode conversion, action triggering.

14. The method according to claim 8, wherein said user-defined alert propagation parameters include at least one among alert types, connection modes with secondary alert recipient user terminals, recipient user terminal identifiers, recipient user categories, alert message content or content modification, time-related conditions, location-related conditions, authorizations for access by second alert recipient user terminals to alert data.

15. The method according to claim 8, further comprising the following step:

re-propagating said secondary alert to another set of user terminals in accordance with secondary alert re-propagation parameters accessible by said user terminals at each user terminal receiving a secondary alert, in accordance with user-defined re-propagation parameters accessible by the user terminals.

16. The method according to claim 8, wherein at least part of said parameters are stored in the user terminals.

17. The method according to claim 8, wherein at least part of said parameters are stored in the monitoring server.

* * * * *